US012029308B2

(12) United States Patent
Stein

(10) Patent No.: US 12,029,308 B2
(45) Date of Patent: Jul. 9, 2024

(54) METHODS AND SYSTEMS FOR A COMBINATION BAG AND TARP WITH A DRAIN FITTING

(71) Applicant: Abadak Inc., Georgetown, TX (US)

(72) Inventor: Michael Stein, Georgetown, TX (US)

(73) Assignee: Abadak Inc., Georgetown, TX (US)

( * ) Notice: Subject to any disclaimer, the term of this patent is extended or adjusted under 35 U.S.C. 154(b) by 141 days.

(21) Appl. No.: 17/970,028

(22) Filed: Oct. 20, 2022

(65) Prior Publication Data

US 2023/0124853 A1 Apr. 20, 2023

Related U.S. Application Data

(60) Provisional application No. 63/257,865, filed on Oct. 20, 2021.

(51) Int. Cl.
*A45F 4/02* (2006.01)

(52) U.S. Cl.
CPC ..... *A45F 4/02* (2013.01)

(58) Field of Classification Search
CPC ..... A45F 4/02
See application file for complete search history.

(56) References Cited

U.S. PATENT DOCUMENTS 748,288 A * 12/1903 Klein ..... A47G 9/08 5/413 R
1,380,167 A 5/1921 Svante
3,477,552 A * 11/1969 Goldman ..... A47C 17/82 5/413 R
3,483,575 A * 12/1969 McCarthy ..... E04H 15/54 5/413 R
4,124,908 A * 11/1978 Burns ..... A61F 5/3776 5/628
4,188,988 A * 2/1980 Agyagos ..... A45C 3/00 383/18
4,375,111 A 3/1983 Hall
5,110,219 A * 5/1992 Lopes ..... A45C 9/00 5/419
D335,396 S * 5/1993 Keadle ..... D6/335
5,370,460 A * 12/1994 Nelson ..... A45F 4/02 383/4
5,533,653 A * 7/1996 Kaufman ..... A45F 4/06 383/4
D374,789 S * 10/1996 Kalista ..... D6/596
5,737,785 A * 4/1998 Casey ..... A45F 4/02 5/419
5,785,219 A * 7/1998 Kraft ..... A47G 9/066 224/901.2
6,128,852 A * 10/2000 Hansen ..... A01G 20/40 47/1.01 R
6,244,481 B1 6/2001 Brougher
6,393,638 B1 5/2002 MacColl
7,028,870 B2 * 4/2006 Valdez-Campbell ..... A45C 7/0095 224/684
7,058,997 B1 6/2006 Klinger
7,231,677 B1 6/2007 Reeves
(Continued)

*Primary Examiner* — Justin M Larson
(74) *Attorney, Agent, or Firm* — Pierson IP, PLLC

(57) ABSTRACT

A bag and tarp combination that can be moved from a usage position to a storage position by folding the fabric along a first axis, folding the fabric along a second axis, rolling portions the fabric in a first direction along a third axis, and rolling portions of the fabric in a second direction along the third axis.

15 Claims, 17 Drawing Sheets

(56) References Cited

U.S. PATENT DOCUMENTS

| | | | | |
|---|---|---|---|---|
| 7,392,614 | B2 | 7/2008 | Kruer | |
| 7,614,100 | B1 * | 11/2009 | Barrington | A47G 9/062 5/413 R |
| 8,256,045 | B2 | 9/2012 | Cruz | |
| 9,032,568 | B2 | 5/2015 | Roney | |
| 9,427,116 | B2 | 8/2016 | Frederick | |
| 9,578,952 | B1 * | 2/2017 | Wray | A45F 4/02 |
| 11,690,353 | B2 * | 7/2023 | Hayashi | A01K 1/029 119/497 |
| 2008/0054032 | A1 * | 3/2008 | Jones | A47G 9/062 5/420 |
| 2008/0134408 | A1 | 6/2008 | Kantor | |
| 2009/0208696 | A1 * | 8/2009 | Frommeyer | A01G 13/0281 428/98 |
| 2018/0213952 | A1 * | 8/2018 | Penn | A47G 9/064 |

* cited by examiner

700

METHODS AND SYSTEMS FOR A COMBINATION BAG AND TARP WITH A DRAIN FITTING

BACKGROUND INFORMATION

Field of the Disclosure

Examples of the present disclosure relate to a bag and tarp combination that includes a drain fitting. More specifically, embodiments are directed towards a bag and tarp combination that can be moved from a usage position to a storage position by folding the fabric along a first axis, folding the fabric along a second axis, rolling portions the fabric in a first direction along a third axis, and rolling portions of the fabric in a second direction along the third axis.

Background

Traditional backpacks typically have a large carrying bag and shoulder straps that are positioned over a user's shoulders. In hiking and camping situations, the amount of weight of camping gear is of greater importance. When backpacking, it is often desirable to efficiently utilize space and load. As such, shelter and backpack combinations have been made.

However, conventional combinations of backpacks and shelters generally will have a rigid shape with a frame, do not maximize the space associated with the fabric, and/or do not minimally compact the fabric in a transport mode while accounting for comfort.

Accordingly needs exist for systems and methods associated with a piece of fabric that can be utilized as a hammock or tarp in first mode and as a bag in a second mode, wherein the fabric is converted from the first mode to the second mode by folding the fabric along a first axis, folding the fabric along a second axis, rolling portions the fabric in a first direction along a third axis, and rolling portions of the fabric in a second direction along the third axis.

SUMMARY

Embodiments disclosed herein describe a system with a textile that can be utilized as a tarp, hammock, etc. in a usage mode and can be folded and rolled along an axis in multiple directions into a bag in a storage mode, wherein a draining fitting is positioned between straps of the bag and an edge of the bag. In embodiments, the system may include a textile, plurality of handles, drain cover, and a bag portion, wherein the bag portion includes at least one insulated pocket, straps, and fasteners.

The textile may be a rectangular shaped piece of fabric, cloth, material, etc., which can be folded and rolled. The textile may be a durable Dynema-like material, which may be UV resistant, fire retardant, abrasion resistant, and/or lightweight. One skilled in the art may appreciate that in other applications, the textile may be any desired shape and/or size.

The plurality of handles may be straps of fabric with first ends coupled to the textile at a first location and seconds ends coupled to the textile at a second location. The plurality of handles may include handles positioned at each of the corners of textile, and along the edges of the textile between the corners of the textiles. The handles may be configured to secure the textile to another object, such as a tree, spike, etc.

In embodiments, when the system is in the storage mode, none of the plurality of the handles may be exposed.

The drain cover may be a piece of plastic, metal, or otherwise rigid material, which may be configured to receive a hose or form an opening within the textile. Responsive to opening the train cover, fluid positioned within the textile may be positioned outside of the textile. This may assist in removing fluid from the textile, which may allow the textile to be used as a rain catcher. In embodiments, the drain cover may be positioned at a position proximate to a center of the longitudinal axis of the textile, which may be positioned the plurality of straps and a distal edge of the textile along the longitudinal axis of the textile.

The bag portion may be configured to be a backpack, bag, or other container. In embodiments, the bag portion may be offset from a first end and a second end along the longitudinal axis of the textile. This may allow the bag to be rolled in a first direction, such that a majority of the textile is positioned between the straps of the bag portion, and then a minority of the textile may be wrapped around the majority portion. The bag portion may include at least one insulated pocket, straps, and fasteners. The insulated pocket may include an opening that can be selectively opened and closed. In embodiments, the at least one insulated pocket may include an upper pocket, central pocket, and lower pocket.

The straps may be backpack straps that extend along a lateral axis, or a shorter axis, of the textile. The straps may be adjustable straps that are configured to be positioned over the shoulders of a user, wherein the straps may be elongated or retracted. In embodiments, the straps may extend along a lateral, or short axis, of the textile, which may extend in a direction perpendicular to the longitudinal axis of the textile.

The fasteners may be pieces of fabric with a first end and a second end, wherein the first end and the second ends are configured to be coupled to each other. In embodiments, the first ends and second ends may be Velcro coupling mechanisms utilizing loops and hooks, buckles, etc. The fabric associated with the fasteners may extend along a longitudinal or long axis, of the textile.

In embodiments to switch the system from a usage mode to a storage mode, a user may position the front of the textile, with the bag portion positioned against a floor surface, against the ground. A first portion of the textile may be folded along the longitudinal axis, along a first plane that is aligned with an upper portion of the upper bag. Then, a second portion of the textile may be folded along the longitudinal axis, along a second plane that is aligned with a lower portion of the lower bag. In embodiments, the first portion of the textile and the second portion of the textile may be substantially equal in area, size, and shape.

When the second portion is folded, it may be positioned over the first portion, such that the first portion is positioned between the second portion and a center portion of the textile, wherein the center portion of the textile may be substantially equal in area, size, and shape to the first portion and the second portion. Next, the user may position the front of the textile upward, and begin to roll the textile along the longitudinal axis. The user may roll the textile until a majority of the textile is positioned between the straps, and then the user may move the minority portion of the textile over the majority portion, and couple to first and second ends of the fasteners together.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
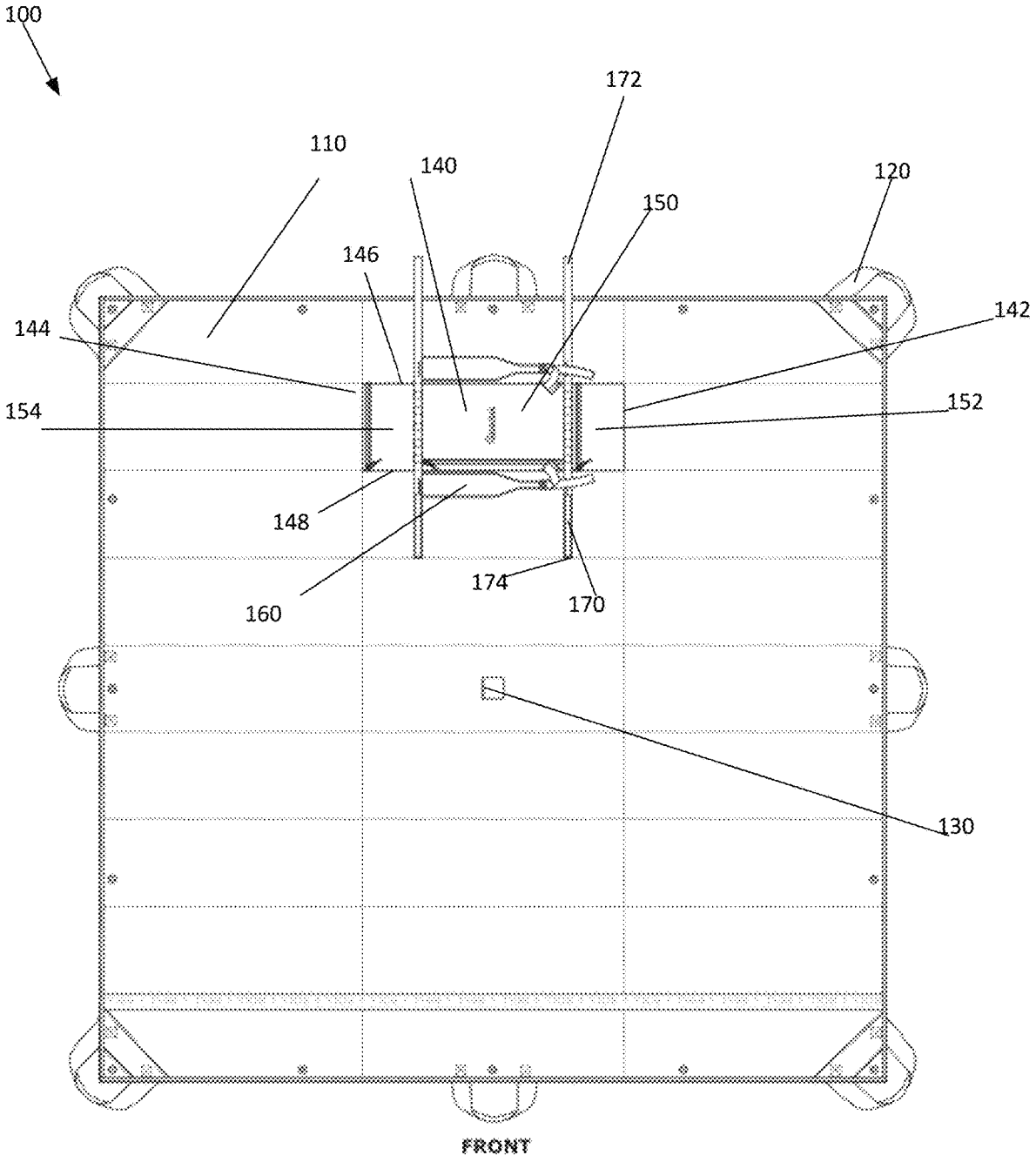
FIG. 1 depicts a front view of a system with a textile that can be utilized as a tarp, hammock, etc. in a usage mode, and can be folded and rolled into a bag in a storage mode.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a front view of a system 100 with a textile 110 that can be utilized as a tarp, hammock, etc. in a usage mode, and can be folded and rolled into a bag in a storage mode. System 100 may include textile 110, handles 120, drain cover 130, and bag portion 140.

Textile 110 may be a rectangular shaped piece of fabric, cloth, material, etc., which can be folded and rolled. Textile 110 may be a durable Dynema-like material, which may be UV resistant, fire retardant, abrasion resistant, and/or lightweight. One skilled in the art may appreciate that in other applications, the textile may be any desired shape and/or size.

Handles 120 may be straps of fabric with first ends coupled to the textile at a first location and second ends coupled to the textile at a second location. Handles 120 may be positioned at each of the corners of textile 110, and along the edges of the textile between the corners of the textiles. Handles 120 may be configured to secure the textile 110 to another object, such as a tree, spike, etc. In embodiments, when the system 100 is in the storage mode, none of the plurality of the Handles 120 may be exposed.

Drain cover 130 may be a piece of plastic, metal, or otherwise rigid material, which may be configured to receive a hose or form an opening within the textile 110. Responsive to opening the train cover, fluid positioned within the textile 110 may be positioned outside of the textile 110. This may assist in removing fluid from the textile 110, which may allow the textile 110 to be used as a rain catcher. In embodiments, drain cover 130 may be positioned between bag portion 140 and a front edge of textile 110, wherein a distance between bag portion 140 and the front edge of textile 110 may be substantially longer than a distance between bag portion 140 and second edge 110.

Bag portion 140 may be configured to be a backpack, bag, or any other type of container that is utilized as a storage compartment. Bag portion 140 may be located on a front surface of textile 110. In embodiments, bag portion 140 may be substantially rectangular in shape, and/or have the same shape as textile 110. Bag portion 140 may be located between a first edge of textile 110 and drain cover 130, such that a distance between bag portion 140 and the first edge is smaller than that between bag portion 140 and drain cover 130. This may allow fluid to flow out of drain cover 130 with minimal interaction with bag portion 140. Bag portion 140 may have an upper boundary 142, lower boundary 144, first side boundary 146, and a second side boundary 148. Each of the boundaries may be offset from an edge of textile 110 at least by a length or width of bag portion 140. This may enable textile 110 to be rolled and folded while comfortable worn by a user. For example, a distance between upper boundary 142 and a first edge of textile 110 and a distance between lower boundary 144 and a second edge of textile 110 may be at least a length of bag portion. Further, a second distance between boundary 146 and a side edge of textile 110 may be at least as wide as a width of bag portion 140. Bag portion 140 may include insulated pockets 150, 152, 154, straps 160, and fasteners 170, 172.

Each of the insulated pockets 150, 152, 154 may include an opening that can be selectively opened and closed. Upper pocket 152 may be positioned central pocket 150 and upper boundary 142, and lower pocket 154 may be positioned between central pocket 150 and lower boundary 144.

Straps 160 may be backpack straps that extend along a lateral axis, or a shorter axis, of the textile 110. Straps 160 may be adjustable straps that are configured to be positioned over the shoulders of a user, wherein the straps 160 may be elongated or retracted. Straps 160 may be offset from a center of the longitudinal axis of textile 110, and extend in parallel to the lateral axis of textile 110. In embodiments, in the storage mode, straps 160 may be positioned on an opposite side of system 100 than pockets 150, 152, 154. When in the usage mode, straps 160 may be positioned within the boundaries of textile 110, such that they do not extend past textile 110. Straps 160 may be positioned between the outer boundaries of pockets 150, 152, 154 along a lateral axis of textile 110.

Fasteners 170 may be pieces of fabric with a first end 172 and a second end 174, wherein the first end and the second ends are configured to be coupled to each other. Fasteners 170 may extend in parallel to the longitudinal axis of textile 110. In embodiments, the first ends 172 and second ends 174 may be Velcro coupling mechanisms utilizing loops and hooks, buckles, etc. The fabric associated with the fasteners 170 may extend along a longitudinal or long axis, of the textile 110. In embodiments, a length of first end 172 may extend past the first side boundary of textile 110, and a length associated with second end 174 may not extend past the boundaries of textile 110. This may allow first end 172 to be coupled with second end 174 when in the storage position, while limiting the portions of bag 140 that are exposed. Specifically, a length of first end 172 may be required to have a longer length than that of bag portion 140 to enable first end 172 to wrap around a majority portion and a minority portion of the bag when the bag is in the storage position.

Figure 2:
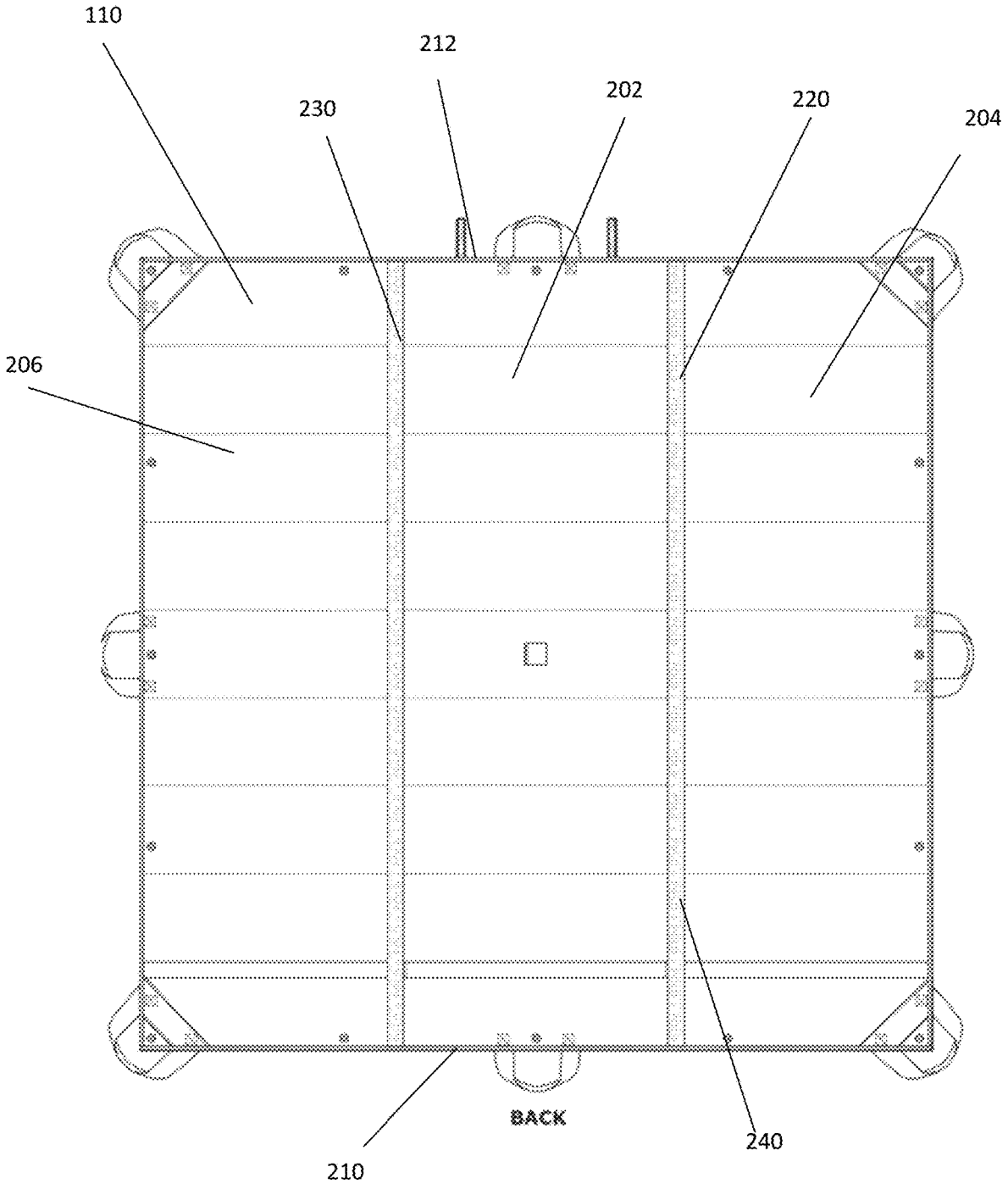
FIG. 2 depicts a back view of a tarp system, according to an embodiment.

FIG. 2 depicts a back view of a system 100, according to an embodiment. Elements depicted in FIG. 2 may be described above, and for the sake of brevity a further description of these elements may be omitted.

As depicted in FIG. 2 textile 110 may be partitioned into three columns 202, 204, 206, wherein center column 202 is separated from a first side column 204 via first fold line 220 and center column 204 is separated from second side column 206 via second fold line 230. In embodiments, each of the columns 202, 204, 206 may have substantially the same height and width.

In embodiments, to switch system 100 from a usage mode to a storage mode, a user may position textile 110 such that the back portion 110 is facing upward, and away from the ground surface. First side column 204 may then be folded over first fold line 220, and second side column 206 may be folded over second fold line 230. This may enable second side column 206 to be overlaid on first side column 204. Then, a distal end 210 of textile 110 may be rolled along an axis 240 that is perpendicular to first fold line 220 and second fold line 230, wherein axis 240 extends along the longitudinal axis of textile 110. Distal end 210 may be rolled passed straps 160. This may cause a first strap to be positioned between the second side boundary 148 and first side boundary 146.

Next, proximal end 212 may be rolled in an opposite direction along the longitudinal axis of textile 110, passed straps 160, to be positioned over the rolled distal end 210 causing a second strap to be positioned between the second side boundary 148 and first side boundary 146. This may enable both portions of straps 160 to be positioned on the opposite side of system than pockets 150, 152, 154. The relative positioning of the straps may increase the comfort and usability of system without having straps 160 extend past the boundaries 146, 148 of the bag along the longitudinal axis of textile 110. Furthermore, positioning proximal end 212 over portions of the rolled distal end 210 may minimize the space required by system 100 in the storage mode, wherein only a single layer of proximal end 212 is positioned over distal end 210. This may additionally provide compressive forces along the longitudinal axis of system 100 to secure the rolled portion in place.

Figure 3:
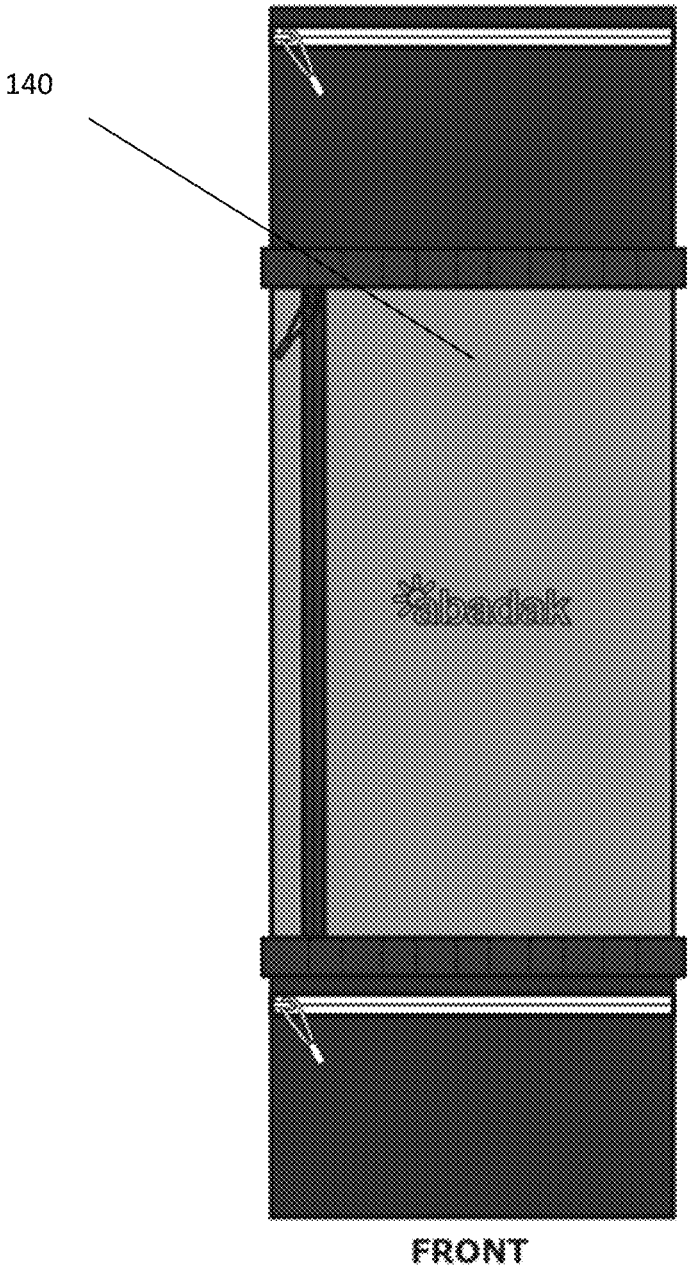
FIG. 3 depicts a front view of a tarp system in a storage mode, according to an embodiment.
Figure 4:
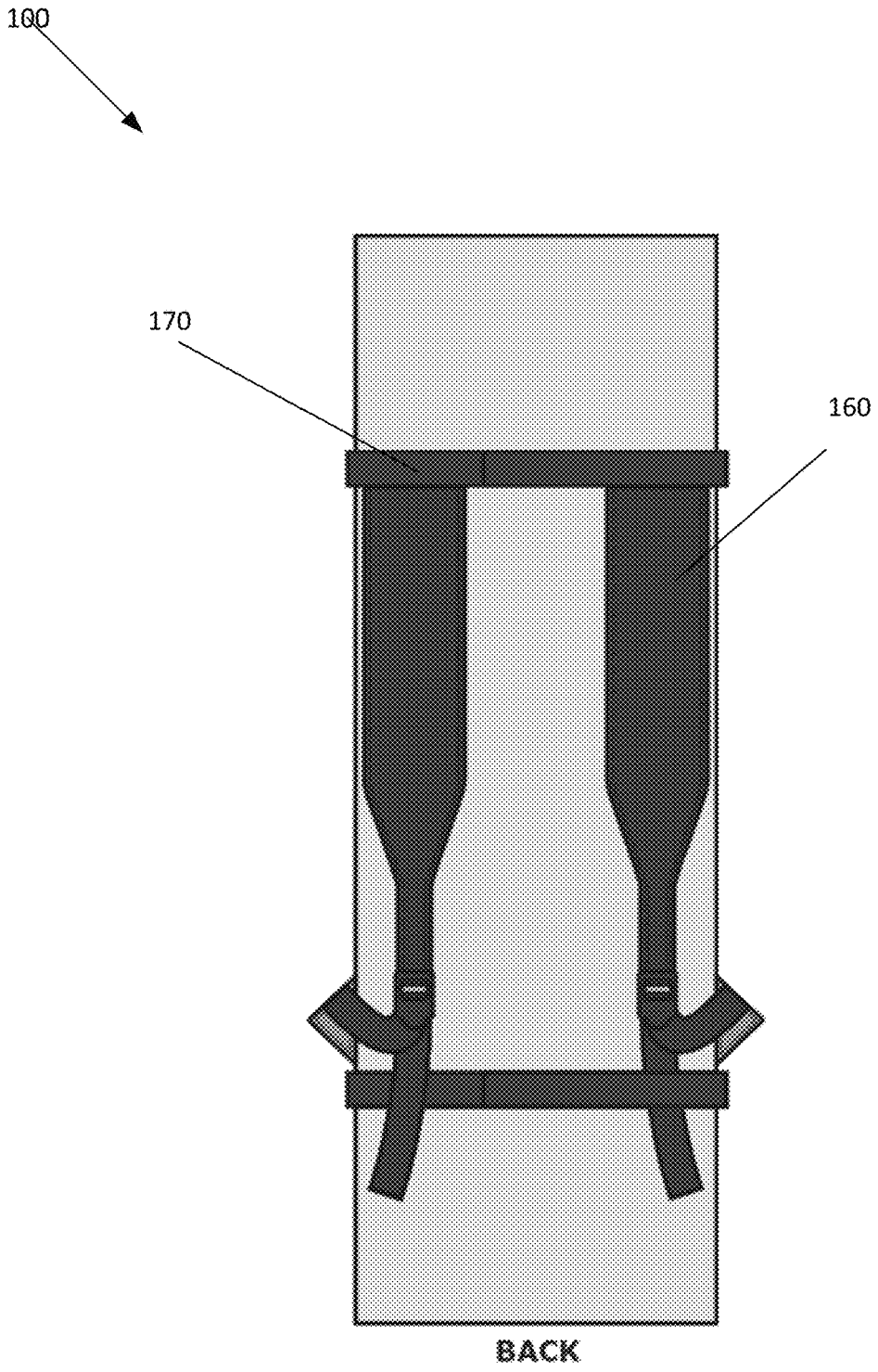
FIG. 4 depicts a rear view of a tarp system in a storage mode, according to an embodiment.

FIG. 3 depicts a front view of system 100 in a storage mode, according to an embodiment. FIG. 4 depicts a rear view of system 100 in a storage mode, according to an embodiment. Elements depicted in FIGS. 3 and 4 may be described above, and for the sake of brevity a further description of these elements may be omitted.

As depicted in FIGS. 3 and 4, when in the storage mode, textile 110 may be wrapped in multiple directions such that straps 160 are secured by fasteners 170. Accordingly, by internally positioning both the straps 160 within a body of textile 110, textile 110 may be rolled and folded into a compact system.

Figure 5:
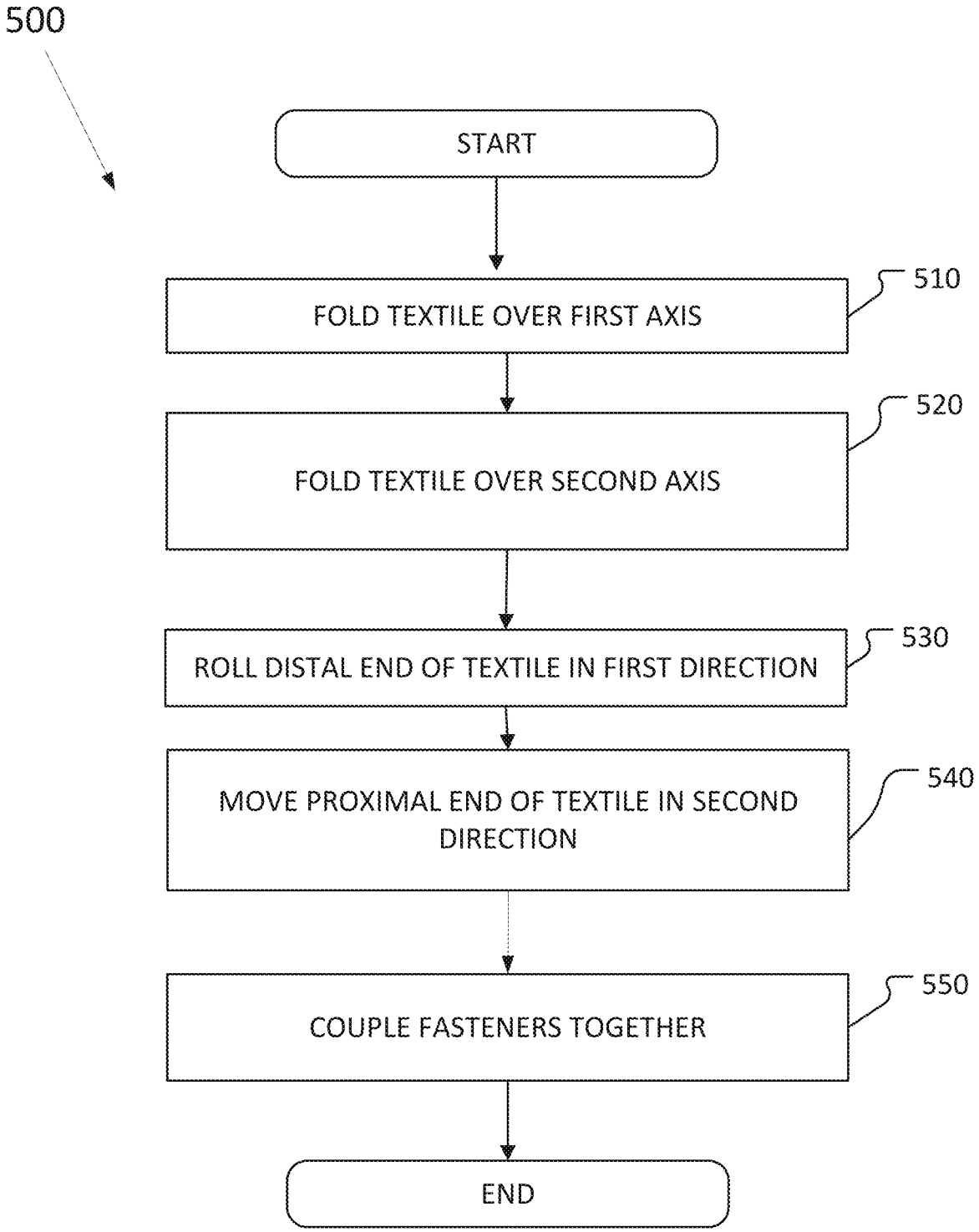
FIG. 5 depicts a method for storing a combination bag and tarp combination, according to an embodiment.

FIG. 5 depicts a method 500 for storing a combination bag and tarp combination, according to an embodiment. The operations of method 500 presented below are intended to be illustrative. In some embodiments, method 500 may be accomplished with one or more additional operations not described, and/or without one or more of the operations discussed. Additionally, the order in which the operations of method 500 are illustrated in FIG. 5 and described below is not intended to be limiting.

At operation 510, a textile may be folded over a first axis.

At operation 520, the textile may be folded over a second axis, wherein the first axis and second axis are in parallel to each other.

At operation 530, a distal end of the textile may be rolled towards a proximal end of the textile. The distal end of the textile may be rolled until the roll is positioned between backpack straps associated with the bag.

At operation 540, the proximal end of the textile may be positioned around portions of the rolled up portion of the textile, wherein the proximal end may not extend around the entirety of the rolled up portion of the textile.

At operation 550, fasteners associated with the bag may be clasped together.

Figure 6:
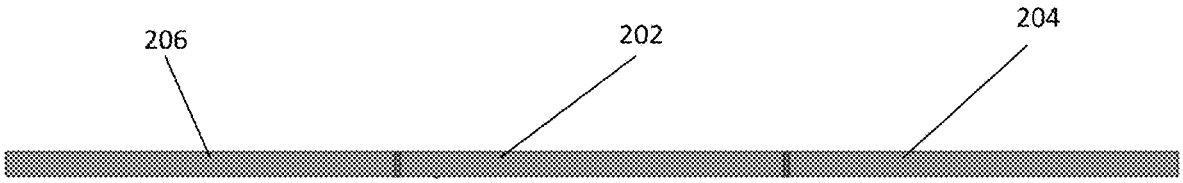
FIG. 6 depicts a side view of a tarp system, according to an embodiment.

FIG. 6 depicts a side view of system 100, according to an embodiment. Elements depicted in FIG. 6 may be described above, and for the sake of brevity a further description of the elements may be omitted.

Figure 7:
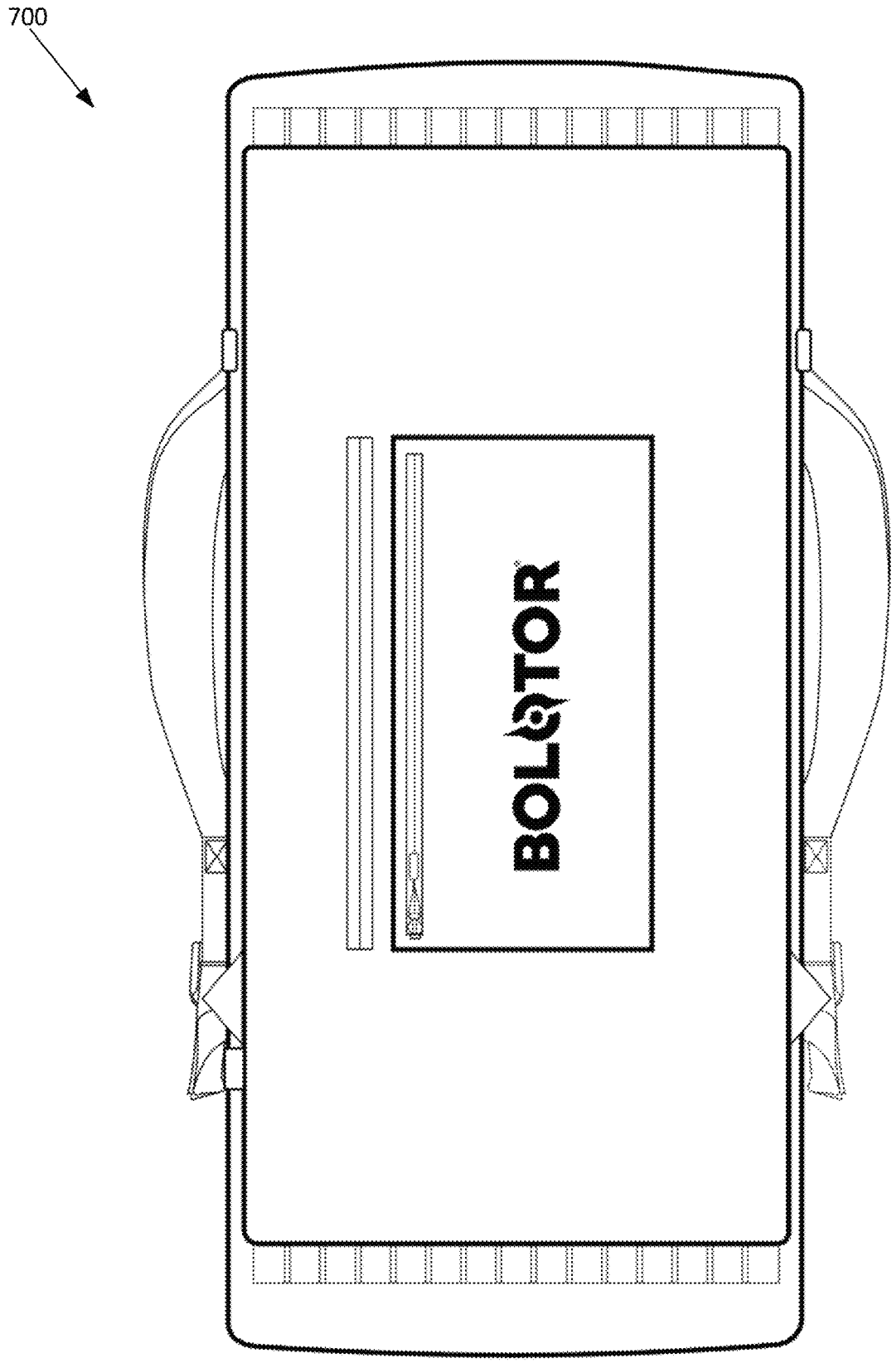
FIG. 7 depicts a top view of a tarp system in a storage mode, according to an embodiment.

FIG. 7 depicts a top view of a tarp system 700 in a storage mode, according to an embodiment.

Figure 8:
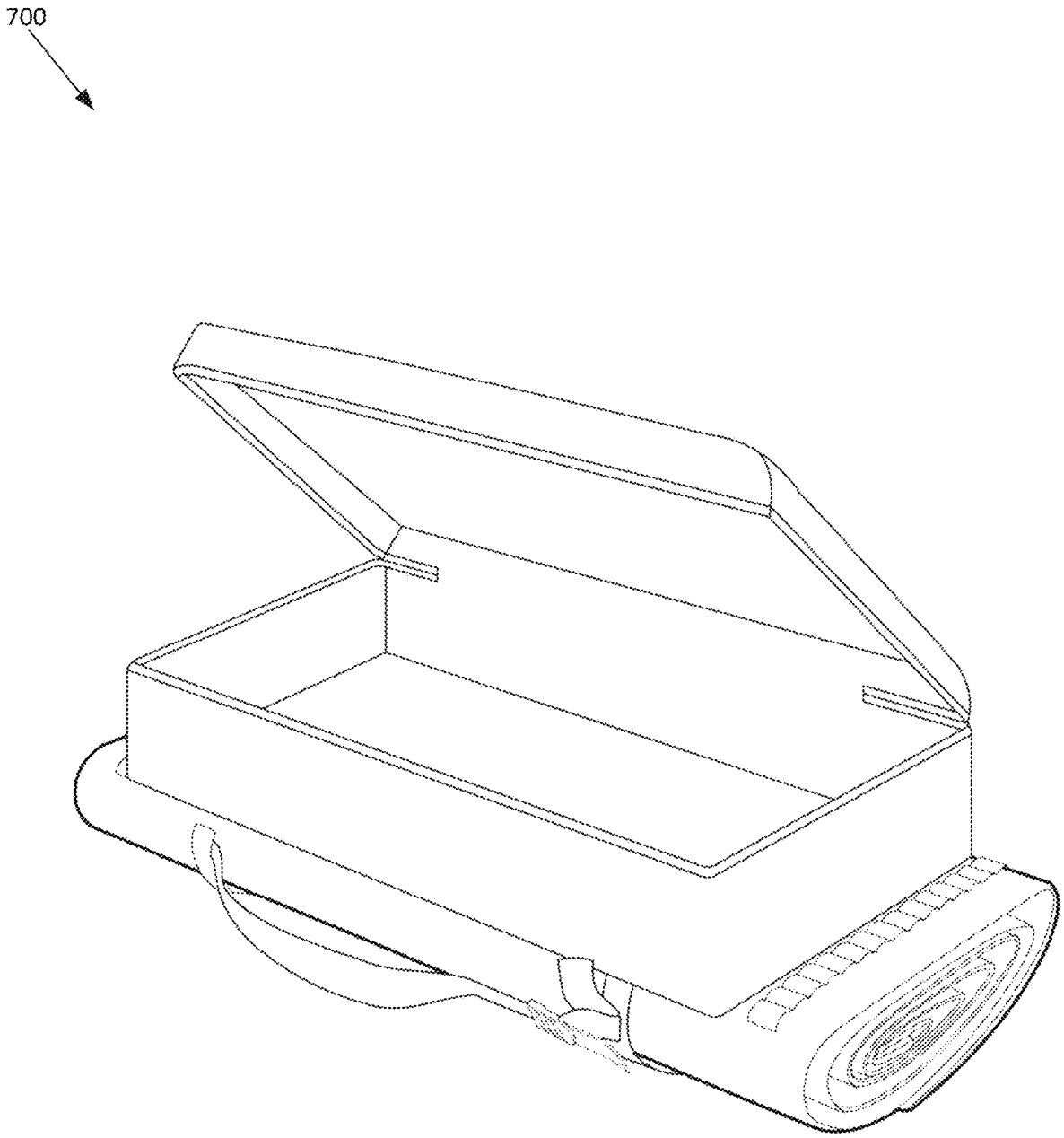
FIG. 8 depicts a side perspective view of a tarp system in a storage mode, according to an embodiment.

FIG. 8 depicts a side perspective view of tarp system 700 in a storage mode, according to an embodiment.

Figure 9:
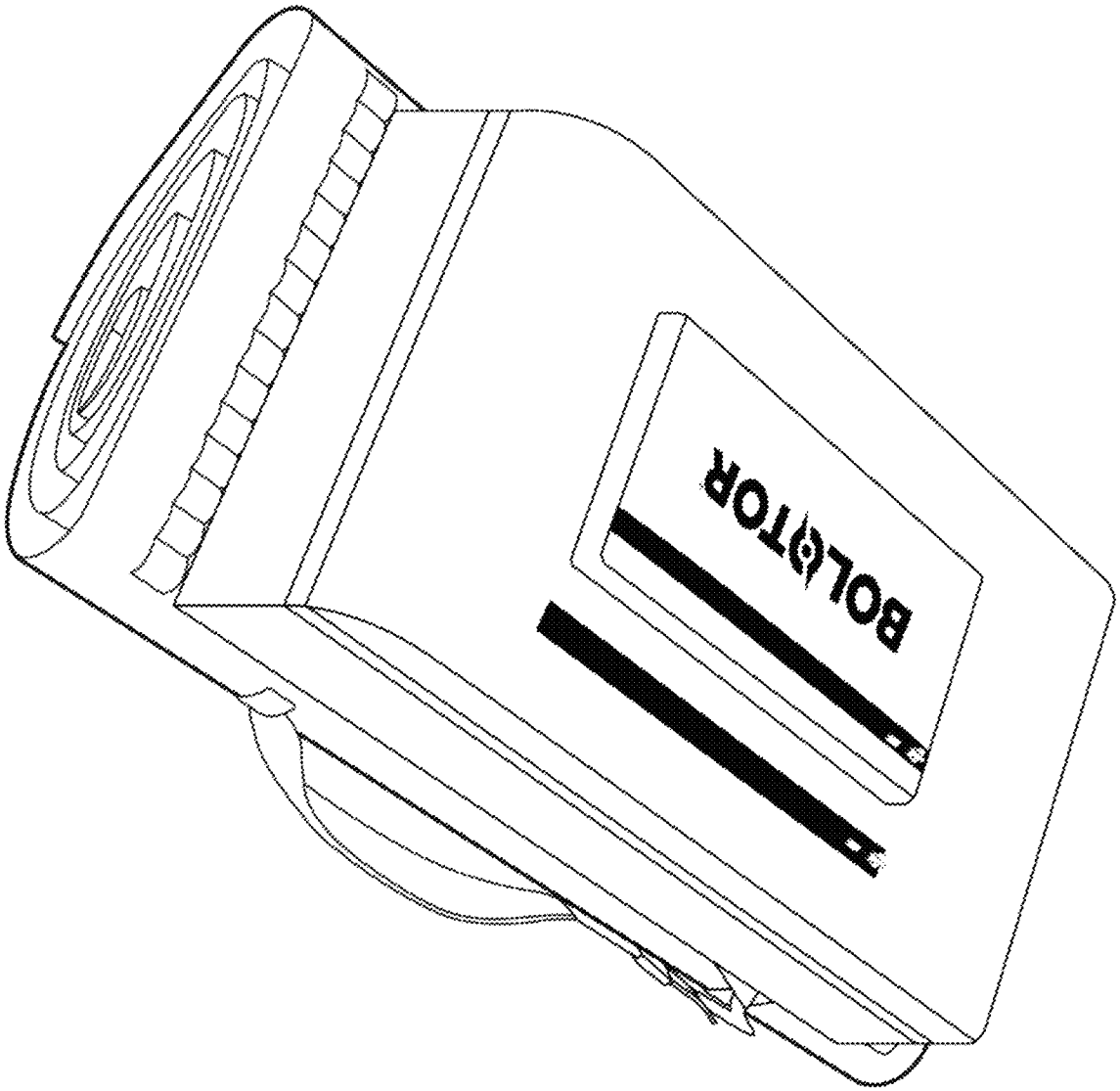
FIG. 9 depicts a perspective view of a tarp system in a storage mode, according to an embodiment.

FIG. 9 depicts a perspective view of tarp system 700 in a storage mode, according to an embodiment.

Figure 10:
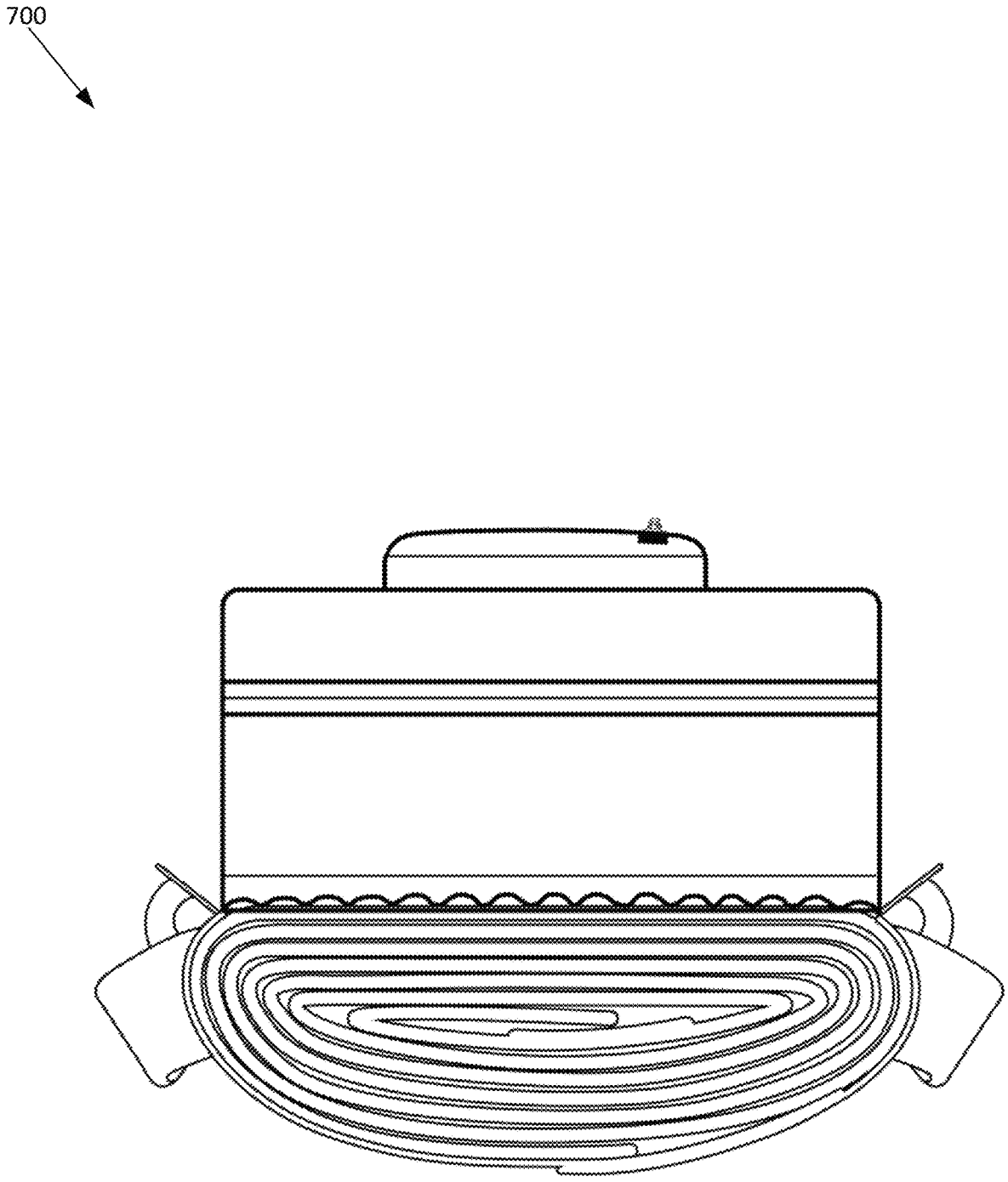
FIG. 10 depicts a front view of a tarp system in a storage mode, according to an embodiment.

FIG. 10 depicts a front view of tarp system 700 in a storage mode, according to an embodiment.

Figure 11:
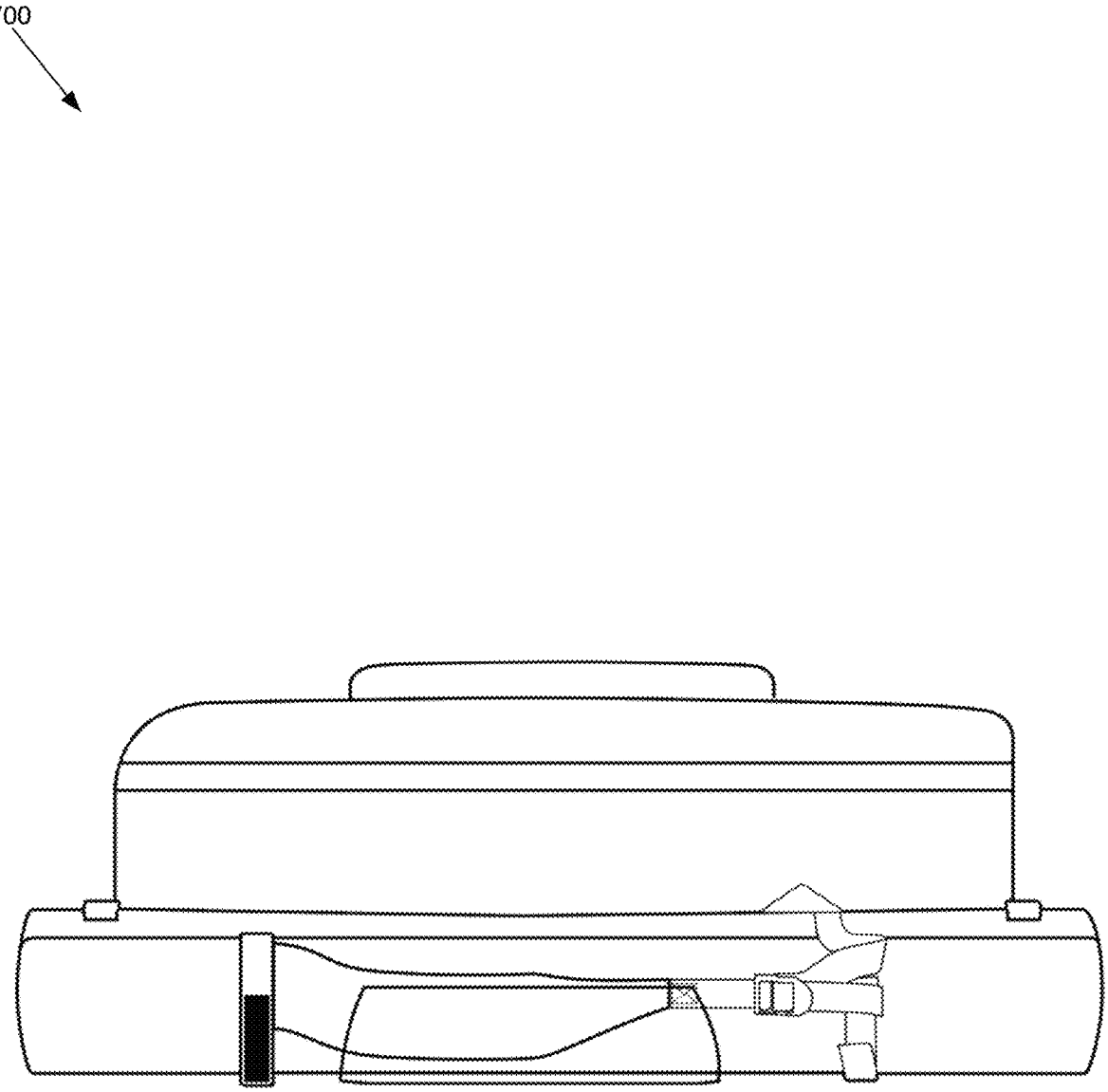
FIG. 11 depicts a side view of a tarp system in a storage mode, according to an embodiment.

FIG. 11 depicts a side view of tarp system 700 in a storage mode, according to an embodiment.

As depicted in FIGS. 7-11, tarp system 700 may be configured to be rolled up along a longitudinal axis of tarp system 700, and transformed into a backpack.

Figure 12:
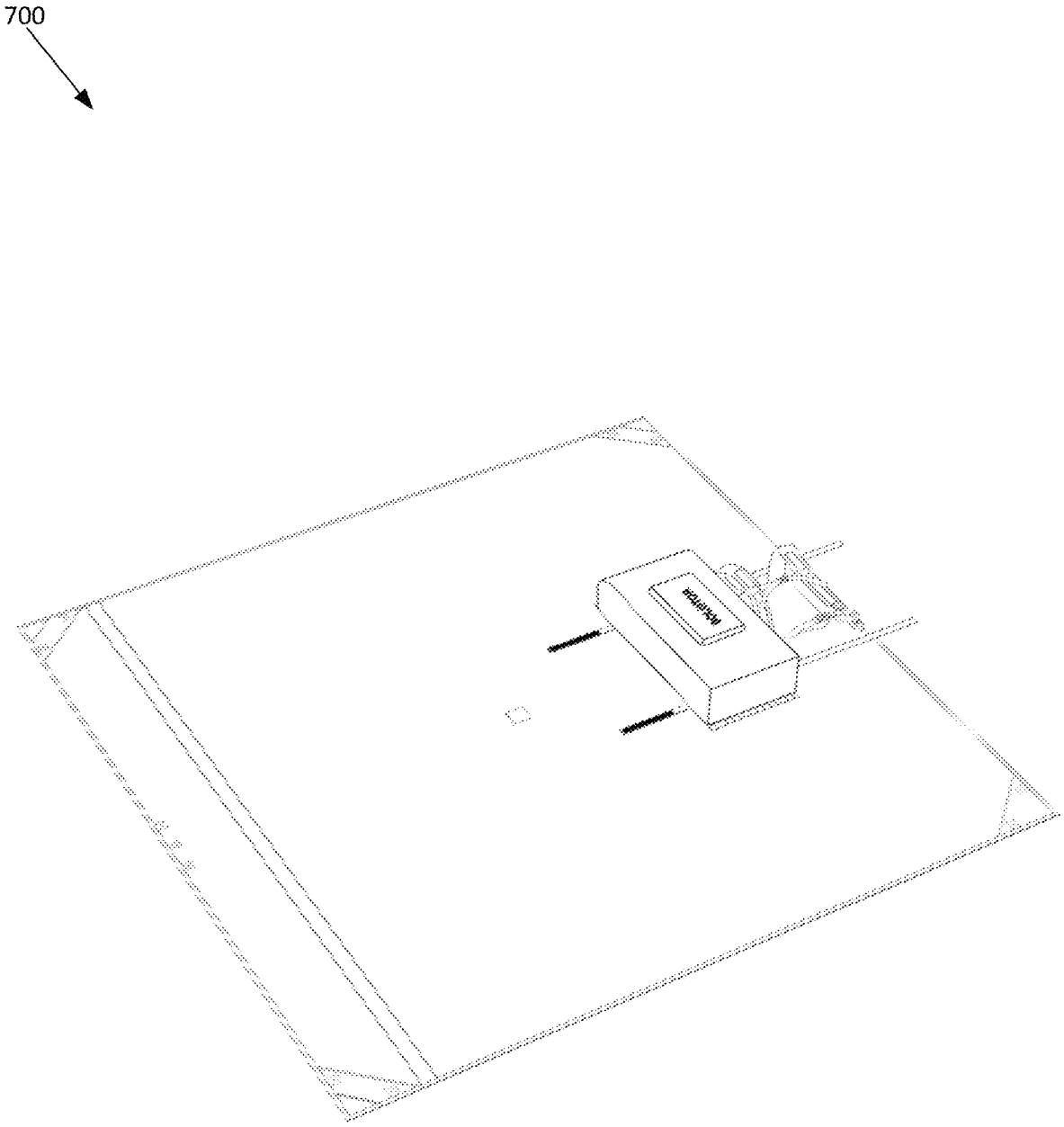
FIG. 12 depicts a side view of a tarp system in a usage mode, according to an embodiment.

FIG. 12 depicts a perspective view of tarp system 700 in use, according to an embodiment.

Figure 13:
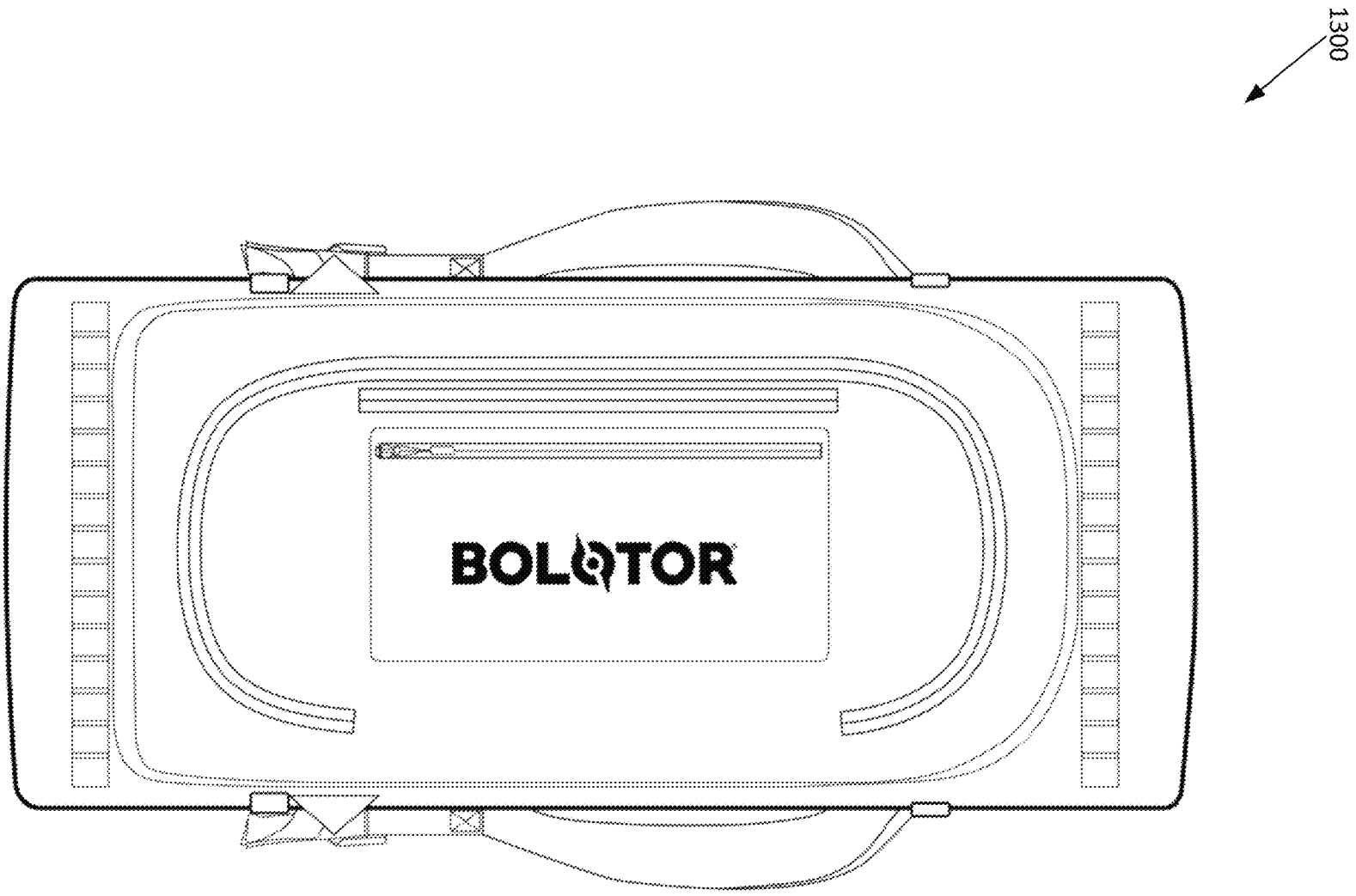
FIG. 13 depicts a top view of a tarp system in a storage mode, according to an embodiment.

FIG. 13 depicts a top view of a tarp system 1300 in a storage mode, according to an embodiment.

Figure 14:
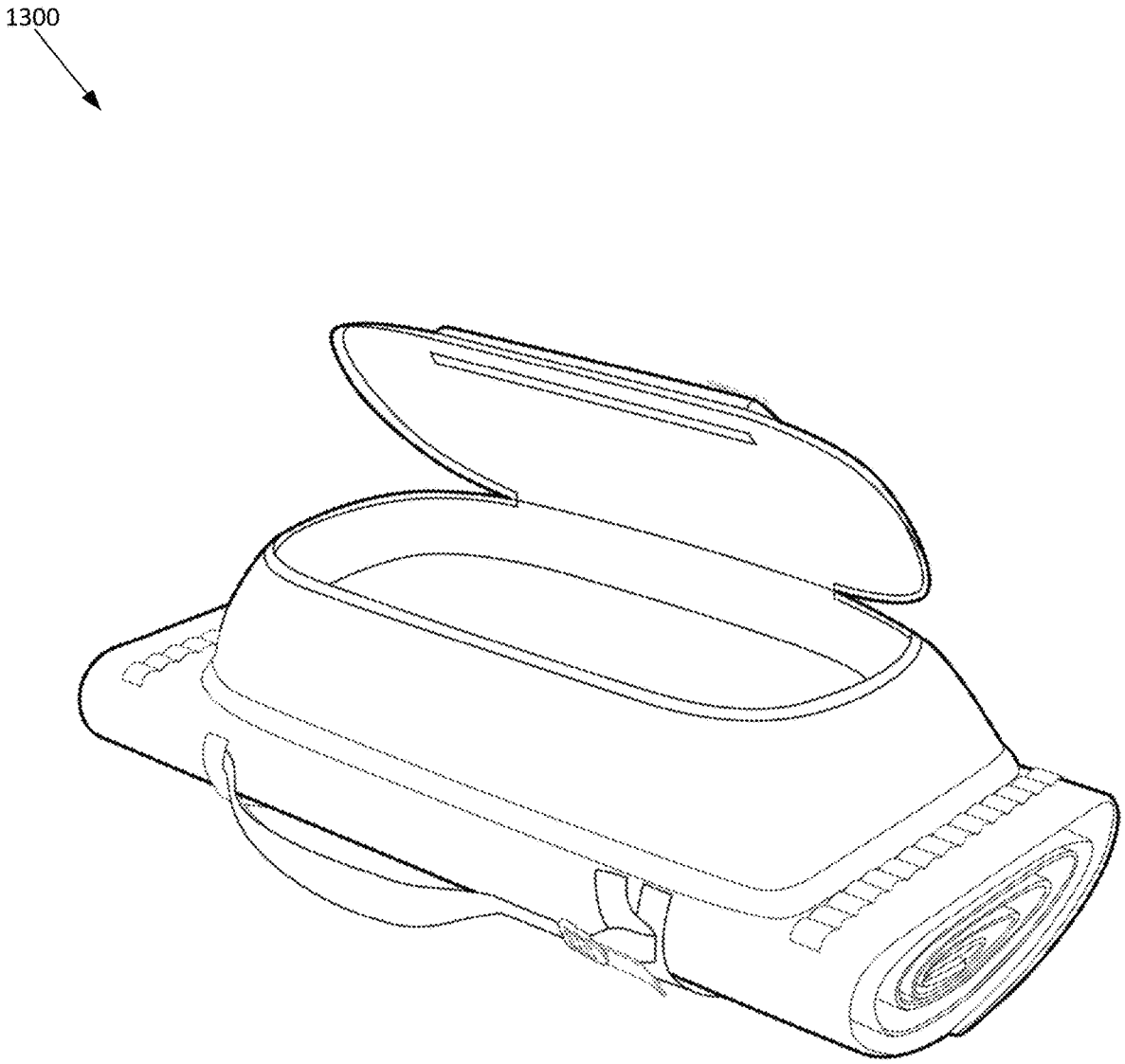
FIG. 14 depicts a side perspective view of a tarp system in a storage mode, according to an embodiment.

FIG. 14 depicts a side perspective view of tarp system 1300 in a storage mode, according to an embodiment.

Figure 15:
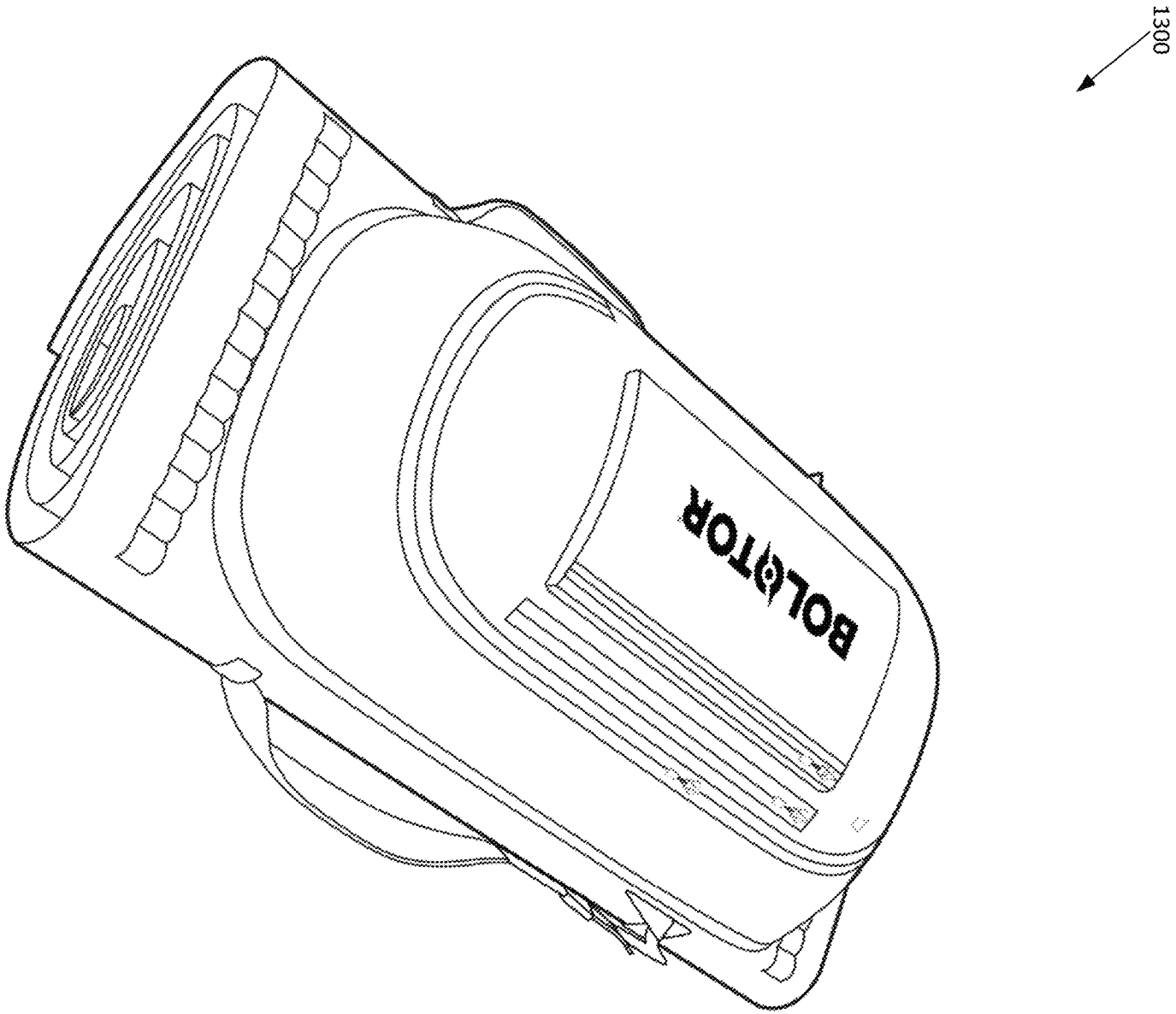
FIG. 15 depicts a perspective view of a tarp system in a storage mode, according to an embodiment.

FIG. 15 depicts a perspective view of tarp system 1300 in a storage mode, according to an embodiment.

Figure 16:
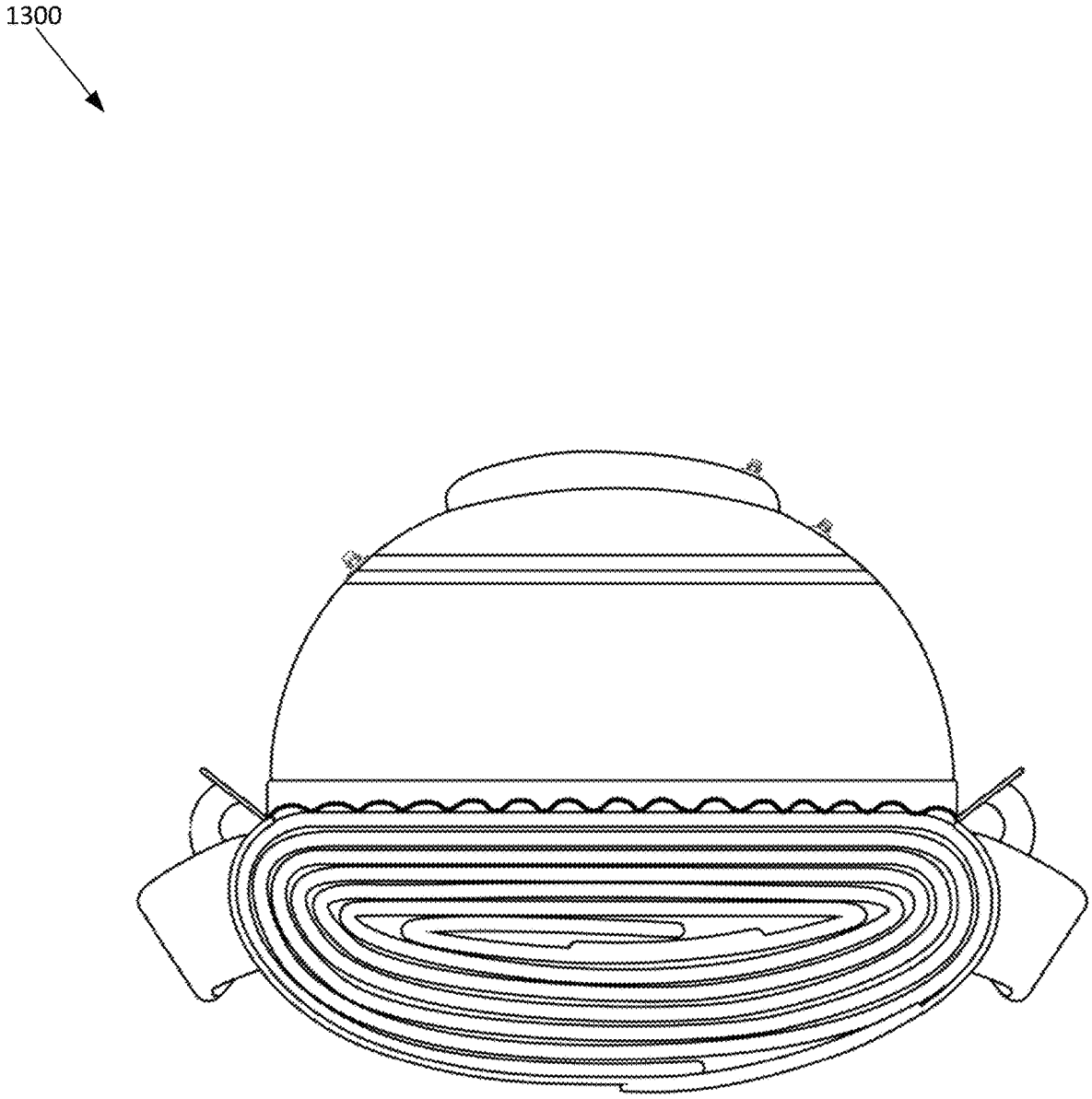
FIG. 16 depicts a front view of a tarp system in a storage mode, according to an embodiment.

FIG. 16 depicts a front view of tarp system 1300 in a storage mode, according to an embodiment.

Figure 17:
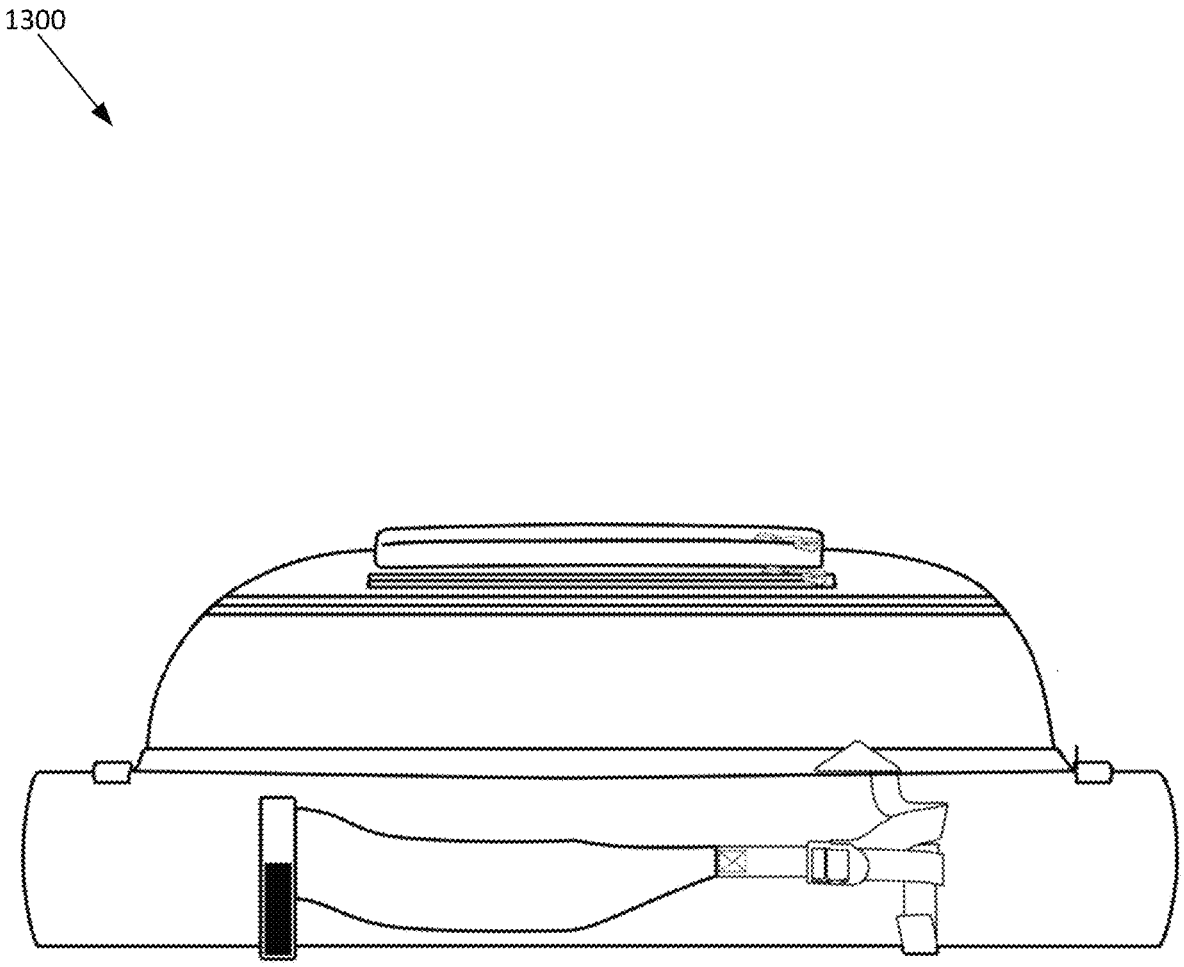
FIG. 17 depicts a side view of a tarp system in a storage mode, according to an embodiment.

FIG. 17 depicts a side view of tarp system 1300 in a storage mode, according to an embodiment.

As depicted in FIGS. 13-17, tarp system 1300 may be configured to be rolled up along a longitudinal axis of tarp system 1300, and transformed into a backpack.

One skilled in the art may appreciate that elements depicted in FIGS. 7-17 may be described above in relation to tarp system 100, and for the sake of brevity a further description of these elements is omitted.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A bag and tarp combination comprising:

a textile with a first edge and a second edge, wherein a first axis extends in parallel to a longitudinal axis of the textile from the first edge to the second edge and a second axis extends in parallel to the longitudinal axis from the first edge to the second edge;

a bag with an upper boundary, lower boundary, first side boundary, and second side boundary, the upper boundary being aligned with the first axis and the lower boundary being aligned with the second axis;

adjustable straps being configured to be positioned over shoulders of a user; the straps extending between the first side boundary and the second side boundary perpendicular to the longitudinal axis, the adjustable straps being positioned outside of first side boundary and the second side boundary;

fasteners with a first end and a second end, the first end being configured to be coupled to the second end, the fasteners extending in parallel to the longitudinal axis of the textile.

2. The bag and tarp combination of claim 1, wherein the straps are positioned closer to the first edge than the second edge.

3. The bag and tarp combination of claim 1, further comprising:

a drain positioned along the longitudinal axis equidistance from the first edge and the second edge.

4. The bag and tarp combination of claim 1, wherein a first distance from the upper boundary to an upper edge of the textile is equal to a second distance from the lower boundary to a lower edge of the textile.

5. The bag and tarp combination of claim 1, further comprising:

a plurality of handles positioned on the first edge and the second edge.

6. The bag and tarp combination of claim 1, wherein the textile is configured to be folded along the first axis, the textile is configured to be folded along the second axis, and the folded textile is configured to be rolled from the second edge towards the bag to be positioned underneath the bag to form a rolled portion of the textile.

7. The bag and tarp combination of claim 6, wherein the first edge of the textile is positioned over the rolled portion of the textile.

8. The bag and tarp combination of claim 7, wherein the adjustable straps include a first strap and a second strap, wherein when the first edge of the textile is positioned over the rolled portion of the textile, the first strap and the second strap are positioned within the first side boundary and the second side boundary.

9. A method for using bag and tarp combination comprising:

folding a textile along a first axis that extends in parallel to a longitudinal axis of the textile from a first edge to a second edge;

folding the textile along a second axis that extends in parallel to the longitudinal axis from the first edge to the second edge;

rolling a first portion of the textile along the longitudinal axis of the textile to position the first portion of the textile under a bag, the bag including an upper boundary, lower boundary, first side boundary, and second side boundary, the upper boundary being aligned with the first axis and the lower boundary being aligned with the second axis;

moving a first adjustable strap from a first position between the first side boundary and the first edge responsive to rolling the first portion of the textile to a second position where the first adjustable strap is positioned under the bag;

folding the second edge of the textile of the rolled first portion of the textile;

moving a second adjustable strap from a third position between the second side boundary and the second edge responsive to folding the second edge of the textile over the rolled first portion of the textile.

10. The method of claim 9, wherein the first adjustable strap and the second adjustable strap extend between the first boundary and the second boundary perpendicular to the longitudinal axis of the textile.

11. The method of claim 9, further comprising:

coupling a first end of a fastener with a second end the fastener, the fastener extending in parallel to the longitudinal axis of the textile.

12. The method of claim 9, wherein the first adjustable strap and the second adjustable strap are positioned closer to the first edge than the second edge.

13. The method of claim 9, further comprising:

draining fluid via a drain positioned along the longitudinal axis equidistance from the first edge and the second edge.

14. The method of claim 9, wherein a first distance from the upper boundary to the upper edge of the textile is equal to a second distance from the lower boundary to a lower edge of the textile.

15. The method of claim 9, further comprising:

utilizing a plurality of handles positioned on the first edge and the second edge to fold the textile.

* * * * *